US006163112A

United States Patent [19]

Ponard et al.

[11] Patent Number: 6,163,112

[45] Date of Patent: Dec. 19, 2000

[54] DEVICE FOR QUICK FREQUENCY TUNING OF A MICROWAVE TUBE USING A DIRECT SENSING MEANS

[75] Inventors: Pascal Ponard, Evian; Marcelin Micallef, Perrignier; Didier Dumont, Thonon les Bains, all of France

[73] Assignee: Thomson Tubes Electroniques, Meudon la Foret, France

[21] Appl. No.: 09/125,030

[22] PCT Filed: Sep. 30, 1997

[86] PCT No.: PCT/FR97/01722

§ 371 Date: Oct. 14, 1998

§ 102(e) Date: Oct. 14, 1998

[87] PCT Pub. No.: WO98/15968

PCT Pub. Date: Apr. 16, 1998

[30] Foreign Application Priority Data

Oct. 4, 1996 [FR] France ..... 96 12125

[51] Int. Cl.[7] ..... H01J 23/213; H01J 25/10

[52] U.S. Cl. ..... 315/5.47; 315/5.553; 331/83; 330/45

[58] Field of Search ..... 315/5.46, 5.47, 315/5.48, 5.49, 5.53, 5.54; 331/83; 330/45

[56] References Cited

U.S. PATENT DOCUMENTS

| | | | |
|---|---|---|---|
| 2,422,465 | 6/1947 | Bondley . | |
| 3,187,220 | 6/1965 | Dench . | |
| 3,617,799 | 11/1971 | Schmidt et al. . | |
| 4,216,409 | 8/1980 | Sato et al. . | |
| 4,527,129 | 7/1985 | Takeyasu | 331/83 X |
| 4,700,146 | 10/1987 | Barton | 331/83 X |
| 4,908,549 | 3/1990 | Bres et al. | 315/5.46 X |

FOREIGN PATENT DOCUMENTS

| | | | |
|---|---|---|---|
| 0 238 236 A2 | 9/1987 | European Pat. Off. . | |
| 103236 | 6/1982 | Japan | 315/5.46 |
| 142737 | 8/1983 | Japan | 315/5.53 |
| 617 251 | 1/1946 | United Kingdom . | |
| 2 024 526 | 1/1980 | United Kingdom . | |

OTHER PUBLICATIONS

Electronique Industrielle, Jan. 1983, XP 002031745, Gerard Cure: Dans les Generateurs de Signaux a Cavite Accordable, le Klystron est Remplace par un Dispositif a Semiconducteurs (pp. 51–54).

*Primary Examiner*—Benny T. Lee

*Attorney, Agent, or Firm*—Oblon, Spivak, McClelland, Maier & Neustadt, P.C.

[57] ABSTRACT

A frequency tuning device for a microwave tube. The tube has one or more resonant cavities which are tuned with the aid of a movable tuning element for each cavity. Each tuning element has an actuating device and a sensor which detects the position of the tuning element. An electronic control is provided for comparing the position of the tuning element supplied by the sensor with a set position and for delivering a control signal to the actuating device which moves the tuning element to the set position.

27 Claims, 4 Drawing Sheets

DEVICE FOR QUICK FREQUENCY TUNING OF A MICROWAVE TUBE USING A DIRECT SENSING MEANS

BACKGROUND OF THE INVENTION

1. Field of the Invention

The present invention relates to a rapid-action frequency tuning device for a microwave tube and to a microwave tube equipped with such a device.

2. Discussion of the Background

This device applies especially to tubes of the klystron family and more particularly to low-power klystrons. These tubes are used in particular as the power stage of a ground station amplifier designed to transmit television or telecommunication signals to a satellite.

Conventionally, a klystron comprises an electron gun which produces a long thin beam of electrons through a body formed by a succession of resonant cavities. Four to six cavities are generally used. A microwave signal to be amplified is injected into the first cavity. The microwave signal interacts with the electron beam and is recovered, amplified in the final cavity, while the electrons are collected in a collector located at the output of this final cavity.

Klystrons, unlike travelling-wave tubes which are also used in ground transmitting stations, do not have a very large instantaneous bandwidth. The bandwidth is of the order of 10 to 100 MHz at most. However, it is possible to make klystrons operate over a wide frequency range and to shift their instantaneous bandwidth, which is much too small, within this frequency range by tuning the central frequency of the tube, that is to say by mechanically adjusting the resonant frequency of one or more cavities of the tube.

A frequency tuning device of known type comprises a tuning element which can be moved inside each cavity that has to be tuned. This tuning element varies either the inductance or the equivalent capacitance of the cavity. This element may be a plunger which varies the internal volume of the cavity or a plate which can be moved in relation to the electron beam. These frequency tuning devices, by means of a manual or motorized selection mechanism, allow a preset configuration of the position of the various tuning elements to be found again, this configuration being called a channel.

In large klystrons, each tuning element is fastened to a threaded rod which extends outside the cavity and which can be screwed on or unscrewed manually. In order to make it easier to set a channel, each of the tuning elements is associated with a counter which counts the number of revolutions of the threaded rod. The information from the counters allows a particular position to be easily found again. The tuning elements are therefore each moved in turn.

Setting all the cavities of a klystron takes approximately 20 seconds and this time is much too long for switching from one channel to another. What is more, the inevitable friction and mechanical hysteresis of the moving parts makes this device somewhat imprecise.

A little time has been saved by using, for each of the channels, a mechanical means of memorizing the position of the tuning elements with the aid of stops. This tuning device comprises several sets of stops on a movable carriage. Each of the sets has one stop per tuning element. The tuning elements bear on the stops of one of the sets. To change channel, all that is required is to retract the tuning elements from the stops with the aid of a suitable device, to change the set of stops by moving the carriage and to reposition the tuning elements so as to bear on the stops of the new set. The tuning elements are therefore moved simultaneously. Elastic elements compensate for the friction and the mechanical hysteresis.

The stop-holder carriage and the device for retracting the tuning elements may be actuated with the aid of motors. This replaces direct human intervention and saves time. However, it is not possible with such a device to change channel in less than four seconds and this time is still regarded as too long. Another drawback of this approach is that this device is mechanically much more complicated and more fragile.

The travel imposed on the tuning elements during their retraction with respect to the stops causes a not insignificant amount of mechanical fatigue of the moving parts. In the motorized version, if an incident occurs, such as the stop-holder carriage being in an incorrect position or a tuning element being blocked, the action of the motors may damage one or more stops, one or more tuning elements or more seriously, one or more resonant cavities.

SUMMARY OF THE INVENTION

The object of the present invention is to help to overcome the aforementioned drawbacks and, in particular, to reduce the channel changeover time to a very short time, for example between a few hundreds of milliseconds and one second, in the case of klystrons operating between 1 and 30 GHz. This very short switchover time makes it possible to use only a single backup tube. Transmitting stations operate, in fact, with several main tubes tuned to different frequencies. With mechanical tuning devices, provision is made, for each main tube, for there to be a backup tube tuned to the frequency of the main tube that it supports. In the event of failure of one of the main tubes, the main tube is switched over to its backup tube in a time of the order of a few hundreds of milliseconds. With the tuning device according to the invention, it is possible to use just one backup tube, this being rapidly tuned to the required frequency before replacing the defective tube. This results in a significant reduction in investment, operating costs and floor space occupied by the equipment integrating the tubes.

In the tuning device according to the invention, the mechanical means of memorizing the position of the tuning elements by means of stops has been replaced with an electronic system for controlling the position of the tuning elements with respect to a set position.

The present invention therefore provides a frequency tuning device for a microwave tube of the klystron family, having one or more resonant cavities to be tuned with the aid of, for each of them, a movable tuning element. This tuning device comprises, for each tuning element, actuating means and a sensor which detects the position of the tuning element. It also comprises electronic control means for comparing the tuning element's position supplied by the sensor with a set value corresponding to a set position and for delivering a control signal to the actuating means which move the tuning element to the set position.

The electronic control means include a microprocessor.

The set position is in a useful configuration saved in a non-volatile electronic memory element. The electronic control means can acquire the set position from the electronic memory element.

It is also possible for the electronic control means to calculate one or more set positions. This calculation can be performed using one or more positions saved in the electronic memory element or using one or more instructions supplied to the electronic control means by a user device to which they are intended to be connected. The electronic control means are capable of saving the calculated positions in the electronic memory element.

It is also conceivable for the set position to be supplied to the electronic control means directly by the user device.

The actuating means comprise a motor optionally associated, if the latter is a rotary motor, with an auxiliary device which converts the rotational motion of the motor into a translational motion communicated to the tuning element.

The motor, the actuating device and the tuning element may be in line with each other or else, for lack of space, it is conceivable for the motor to be in line with a driving shaft of the auxiliary device, for the tuning element to be in line with a driven shaft of the auxiliary device and for the driven shaft and the driving shaft to be offset one with respect to the other.

In the latter configuration, the driving shaft can be rotated by the motor and can drive a support arm in translation, this support arm being integrated with the driven shaft and ensuring the offset.

It is advantageous, so that the tuning device can be easily adapted to any tube, to group together the auxiliary devices, if there are any, the position sensors and the electronic memory element into a positioning module fixed to the tube.

In this case, support arms of different sizes depending on the microwave tubes may be provided.

The electronic control means and the motors may be grouped together into a control module which may be fastened to the positioning module.

Provision may also be made for the electronic control means to be capable of carrying out a safety test which prevents any movement of a tuning element in the event of a fault in the position sensor associated with this tuning element being detected.

Provision may also be made for the electronic control means to operate with a password in order to limit access to the controls at risk, such as the information stored in the electronic memory element and the movement of the tuning elements.

The present invention also relates to a microwave tube which uses such a tuning device.

BRIEF DESCRIPTION OF THE DRAWINGS

Other features and advantages of the invention will emerge from the description of embodiments given by way of non-limiting example, the description being illustrated by the appended figures which depict.

DETAILED DESCRIPTION OF THE PREFERRED EMBODIMENTS

Figure 1:
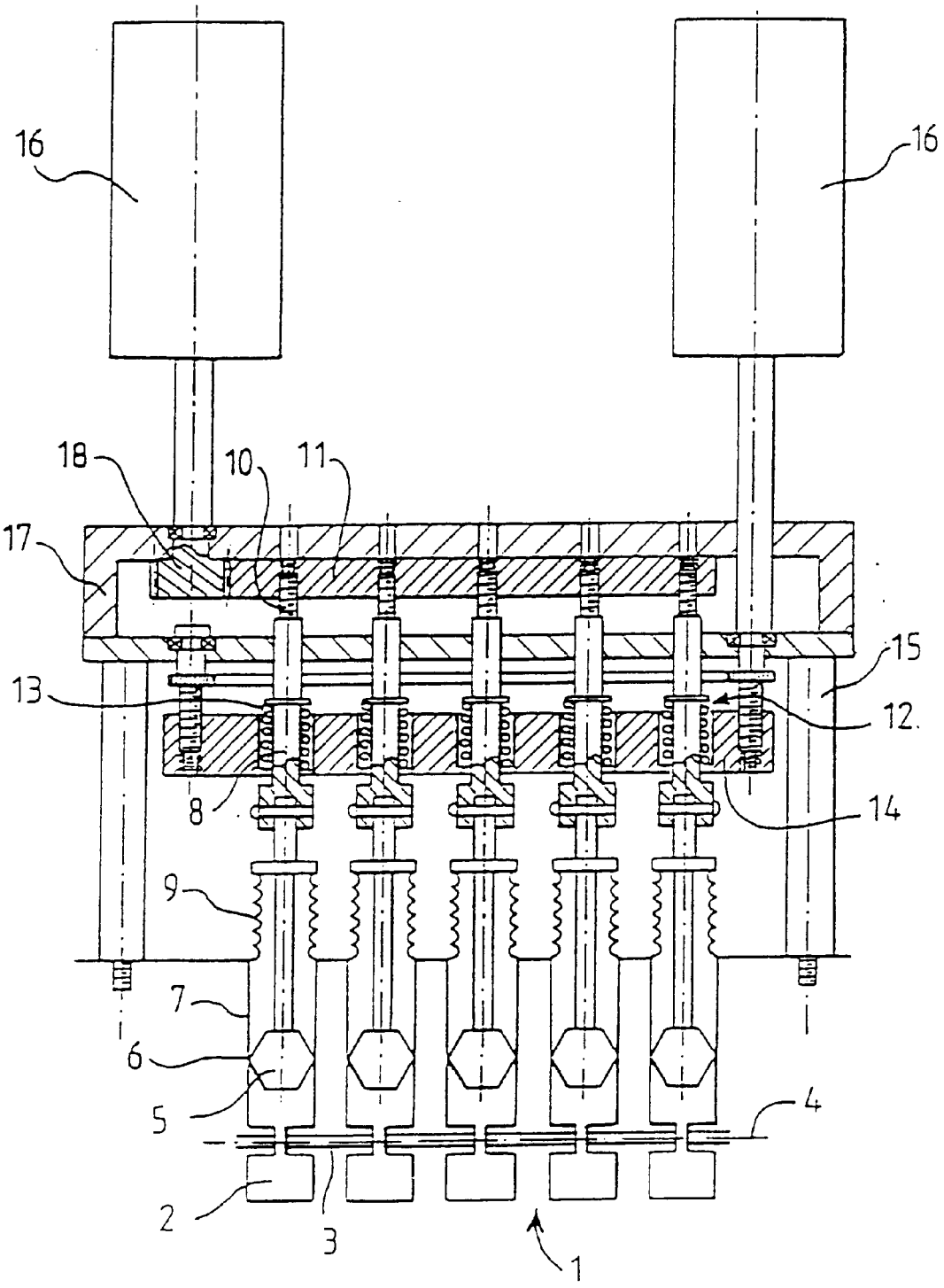
FIG. 1 PRIOR ART
FIG. 1: a sectional view of a klystron equipped with a tuning device of known type.

The frequency tuning device of the klystron shown in FIG. 1 has a mechanical means of memorizing the position of the tuning elements with the aid of stops. In all the examples described, the tuning elements are plungers and this term is employed in the rest of the description. Of course, it is conceivable to replace these plungers with plates or any other equivalent component.

The klystron is depicted partially, its gun and its collector having been omitted as they are not involved in the tuning device. Only its body 1, comprising a succession of five resonant cavities 2, may be seen. The cavities 2 are connected to each other by drift tubes 3. Their walls are labelled 7. The electron beam 4, depicted by a dashed line, passes through the cavities 2, the drift tubes 3 and is held focused by a magnetic field (not depicted).

The frequency tuning device comprises, per cavity to be tuned, a plunger 5 which can move inside the cavity 2. This plunger terminates, in the cavity, in a part 6 which provides a moving electrical contact with its walls 7. In this example, all the cavities are equipped with plungers, but it is conceivable for some of them not to be equipped with plunges.

A vacuum is created inside the cavities 2. On the other side, the plunger 5 extends outside the cavity by a rod 8 which allows it to be actuated. A vacuum-type seal is provided by a deformable metal bellows 9 fastened on one side to the walls 7 of the cavity and on the other side to the rod 8.

The rods 8 of the plungers 5 are held, in the operating position, pushed against stops 10 carried by a carriage 11 which can move by means of a resilient holding device 12. The resilient holding device 12 comprises a movable support plate 14 on which springs 13 bear, the springs being compressed in this operating position. There are as many springs 13 as there are rods 8.

The stop-holder carriage 11 comprises several sets of stops, each of them corresponding to one channel. Each set comprises as many stops as there are plungers. The carriage may be of quadrangular shape and can move in translation, as illustrated in FIG. 1, or else in the form of a wheel, and can move in rotation. Several channels may thus be preset, but the number of them is limited by the lack of space. Currently, the maximum number of channels is twenty-four. The stops 10 may be produced by screws penetrating the carriage 11 to a greater or lesser extent.

To change channel, the stops 10 must be released from the pressure exerted by the rods 8. To do this, the support plate 14 is moved with the aid of a shaft from its locked position in which the springs 13 are compressed to an unlocked position in which the springs 13 are relaxed, so as to retract the rods 8 from the stops 10. The stop-holder carriage 11 is then free and can be moved in translation by a rack-and-pinion system 18 in order to bring another set of stops 10 opposite the rods 8. A reverse action on the support plate 14, moving it to the locked position, allows the springs 13 to be compressed so that the rods 8 bear on the new set of stops 10.

The stop-holder carriage 11 and the support plate 14 may be actuated with the aid of motors 16, thereby dispensing with direct human intervention. The frequency tuning device in its entirety is fastened to a base 17 fixed to the body 1 of the tube.

Figure 2:
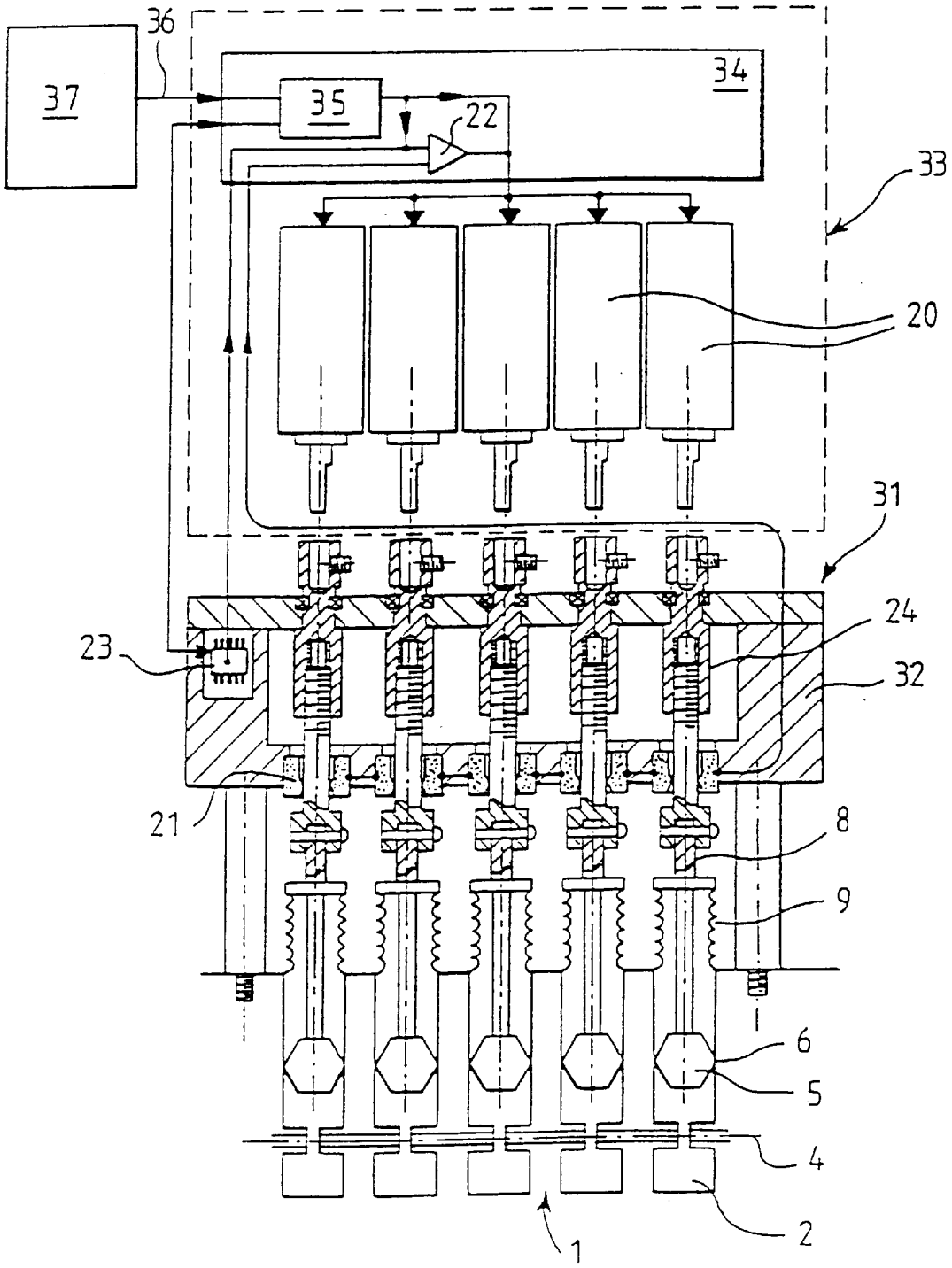
FIG. 2: a sectional view of a klystron equipped with a frequency tuning device according to the invention.
Figure 3:
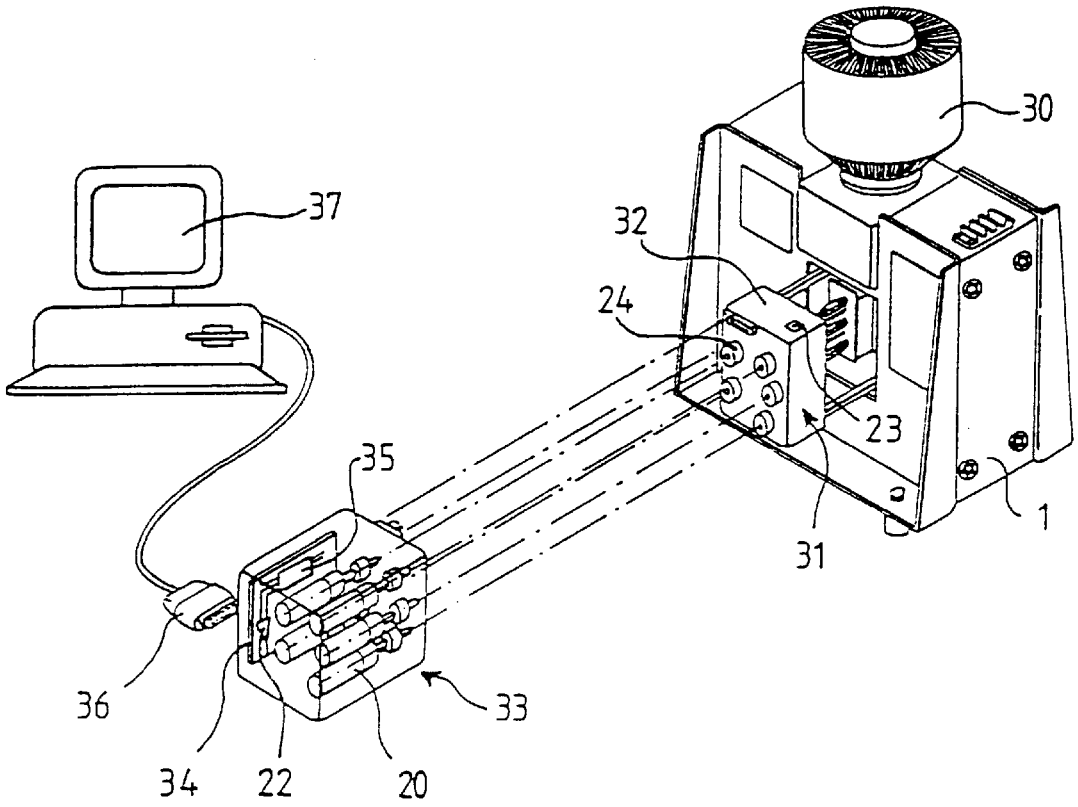
FIG. 3: an exploded view of the klystron shown in FIG. 2, equipped with the tuning device.

FIG. 2 shows, in the same way as FIG. 1, a klystron equipped with a tuning device according to the invention. The elements labelled 1 to 9 are the same as in FIG. 1. FIG. 3 may be examined at the same time as FIG. 2 as it complements it.

The frequency tuning device comprises, for each cavity 2 to be tuned, a tuning element depicted in the form of a plunger 5 which is actuated with the aid of actuating means 20, 24. These actuating means comprise, for each plunger 5, a motor 20 which, if it is a rotary motor, is associated with an auxiliary device 24. The auxiliary device 24, for example of the nut-and-screw type, converts the rotational motion of the motor into a translational motion applied to the plunger 5. There are as many motors 20 and auxiliary devices 24 as there are plungers 5. The auxiliary device may be dispensed with if the motor is a linear motor.

In FIG. 2, the auxiliary devices are not depicted connected to the motors 20 as the motors and the auxiliary devices may form part of different modules, as will be seen in FIG. 3.

Since the forces to be provided in order to move the plungers 5 are minimal, very small motors may be used and the amount of space they take up is small enough to be able to place them relatively close to the plungers 5, the auxiliary device 24 also being as compact as possible. The motors, the actuating devices and the plungers are in line with each other.

As seen in FIG. 2, a position sensor 21 interacts with each of the plungers 5. It gives, permanently, the position of the plunger 5 with which it interacts. The position sensor may, for example be of the read-out potentiometer type. The measurement is carried out outside the cavity.

The tuning device comprises electronic control means 34 which compare the measured position with a set position and which deliver a control signal to the actuating means 20, 24. The actuating means 20, 24 move the tuning element 5 to the set position. The set position may be saved in a non-volatile electronic memory element 23 (see FIG. 2), for example an EEPROM memory. This electronic memory element 23, when it is loaded, is specific to the tube with which it interacts. Several sets of set positions corresponding to several channels may be stored in the electronic memory element 23. The number of them is not limited, as in the configuration shown in FIG. 1.

By measuring the position of the plungers 5 directly, the position sensors 21 (see FIG. 2) improve the precision of the tuning device since it is possible to avoid the mechanical play introduced, in particular, by the auxiliary device 24.

A channel changeover is effected by acquisition, for each plunger to be moved, of a set position, by comparing this position with the position measured by the sensor 21 associated with this plunger 5 and by actuating the corresponding motor 20 until there is equality between the measured position and the set position. As well as saving a very considerable amount of time, there is greater reliability compared with mechanical-memory tuning devices since a channel changeover involves much fewer mechanical moving parts.

In the embodiment shown in FIG. 3, the body 1 of the klystron is parallelepipedal in shape. The collector 30 may be seen here and is cylindrical in shape. The frequency tuning device, apart from the plungers 5 which are fitted into the cavities during assembly of the various components of the tube and the rods 8 of which emerge from the cavities, is divided into two modules. One of the modules, called the positioning module 31, comprises a base 32 fixed to the body 1 of the tube, the other module, called the control module 33, being fitted onto the base 32. The positioning module 31 may be installed without any problem on a klystron already equipped with a mechanical-memory tuning device as a replacement of the existing tuning device.

The base 32 of the positioning module 31 carries the electronic memory element 23 (see FIG. 2), the positioning sensors 21 and the auxiliary devices 24 (if there are any) which fit onto the rods 8 of the plungers 5. In FIG. 3, the position sensors cannot be seen. This positioning module 31 is specific to one particular tube when set positions have been saved in the electronic memory element 23.

As seen in FIG. 2, the control module 33, which can be electrically and mechanically connected to the positioning module 31, comprises motors 20 and the electronic control means 34.

Figure 4A:
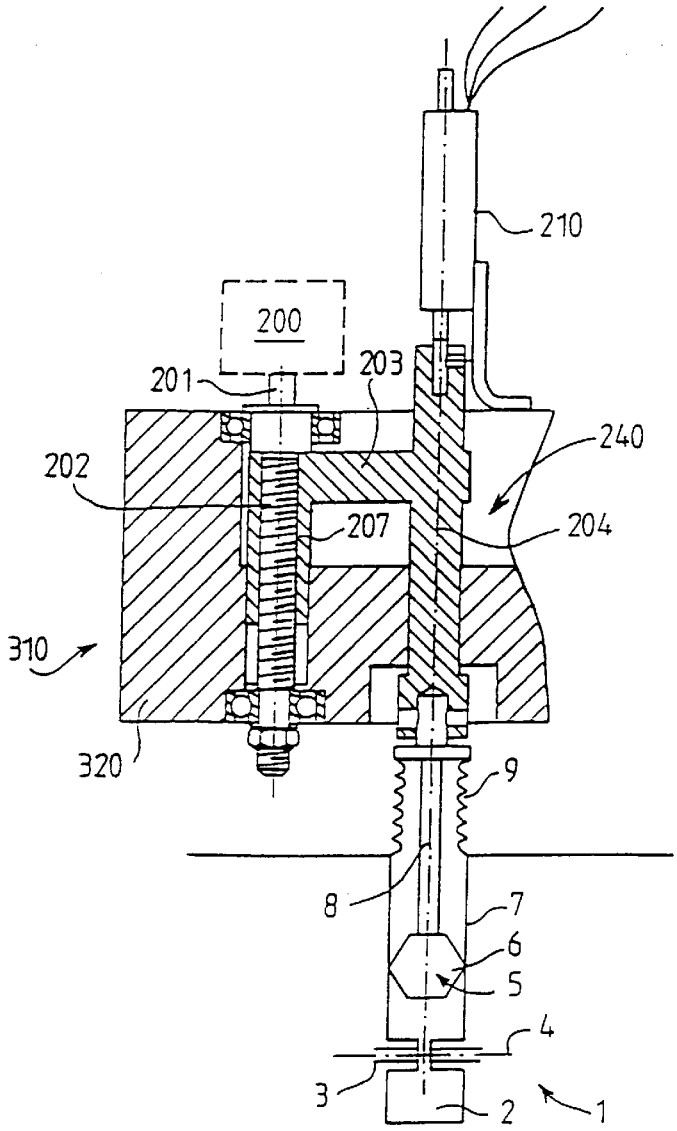
FIGS. 4*a,* 4*b:* an embodiment of the positioning module of a tuning device according to the invention in partial section and in a top view, respectively.
Figure 4B:
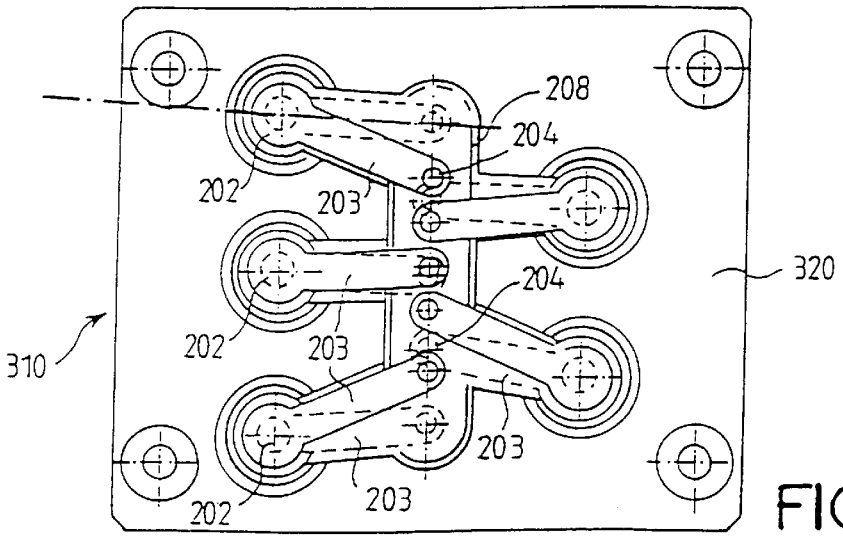

FIGS. 4*a*, 4*b* show, respectively in section and in a top view, but only partially, an embodiment of the positioning module 310 of a tuning device according to the invention.

In FIG. 4*a*, the elements labelled 1 to 9 are the same as in FIG. 1.

The actuating means 240, 200 comprise, for each plunger 5, an auxiliary device 240 and a motor 200. In FIG. 4*a*, a single plunger 5 is depicted, and consequently a single auxiliary device 240. There is also only a single motor 200, which is depicted by dashes as it does not form part of the positioning module 310. The base of the positioning module is labelled 320.

Compared with FIG. 2, it should be pointed out in FIG. 4*a* that the motor 200 has a drive shaft 201 which is no longer in line with the plunger 5 that it has to actuate. The drive shaft 201 of the motor is in line with a driving shaft 202 of the auxiliary device 240, the motor rotating this driving shaft 202. The driving shaft 202 is housed in the base 320. The driving shaft 202, by rotating, drives a support arm 203 in translation, this support arm being integral with a driven shaft 204. The driven shaft 204 is fastened to the plunger 5, these being arranged in line with each other. The support arm 203 and the driven shaft 204 also form part of the auxiliary device 240. The driven shaft 204 also passes through the base 320.

The support arm 203 terminates on one side in a threaded sheath 207 which surrounds the driving shaft 202, the latter also being threaded. On the other side, it is integral with the driven shaft 204 and prevents the latter from rotating. The driven shaft 204 then moves in translation, like the support arm 203 and communicates its movement to the plunger 5.

By virtue of the support arm 203, the driven shaft 204 and the driving shaft 202 are offset one with respect to the other. This makes it possible to be able to house the motors if the inter-plunger distances are very small.

In klystrons operating at high frequencies, for example greater than 14 GHz, the inter-cavity distance is only about 5 to 6 millimeters, two successive plungers 5 being separated by this distance. This arrangement allows very closely spaced plungers to be actuated.

As seen in FIG. 4*a*, the position sensor 210, which forms part of the positioning module 310, interacts with the driven shaft 204. In FIG. 4A, it lies on the opposite side from the plunger 5 with respect to the driven axis.

Of course, it would have been possible to place it on the same side as the plunger 5. This arrangement makes it possible to circumvent any inevitable mechanical play introduced between the driving shaft 202 and the sheath 207.

Another advantage of this arrangement is that the positioning module may be adapted to various klystrons, the centre-to-centre distances of whose plungers could have different values.

In FIG. 4*b*, the driving shafts 202 are in a fixed axial position with respect to the base 320 of the positioning module. The base 320 has a slot 208 level with the driven shafts 204. This allows them to be connected to plungers 5 whose centre-to-centre distances are variable. By fastening each plunger 5 equipped with its position sensor 210 to a driven shaft 204 and by adapting the length of each support arm 203 to the distance between a driving shaft 202 and a driven shaft 203, it is possible to use the same type of positioning module with several klystrons operating in different frequency ranges.

In FIG. 4*b,* the support arms 203 and the driven shafts 204 corresponding to a first type of klystron are depicted in solid lines and those corresponding to a second type of klystron covering another frequency range are depicted in dashed lines. The positions of the plungers of the second type of klystron are different from those of the first type.

As regards the control module 33 (see FIG. 2) with the motors and the electronic control means, this is completely standard and interchangeable for any type of klystron insofar as it is compatible with the positioning module 31 (see FIG. 2).

These electronic control means 34 are depicted in the form of an electronic card with a microprocessor 35 and a comparator device 22 which, in particular, receives the positions measured by the sensors 21 and the set positions. The microprocessor is run by suitable built-in software. The electronic control means 34 are designed to receive instructions from a user device 37. A link 36, for example a serial link of the RS232-422 type, is provided for the connection between the electronic control means 34 and the user device 37, which may be a computer.

As seen in FIG. 2, these electronic control means 34 are provided for managing the electronic memory element 23 in read mode. When they receive an instruction to switch over from one channel to another channel preset in the electronic memory element 23, they acquire, from the electronic memory element 23, for each plunger to be moved, the set position corresponding to the new channel and they compare the set position with the position measured by the corresponding sensor 21. They deliver a control signal to the actuating means of the corresponding plunger.

The tuning of the tube to a new channel which has not been initially preset may be carried out automatically by the tuning device according to the invention. The electronic control means 34 are designed to calculate one or more new set positions, corresponding to this new channel, using one or more set positions already saved in the electronic memory element 23, by interpolation and extrapolation. After comparing them with the measured positions, the plungers 5 are actuated and moved until they adopt the calculated positions. This calculation capability facilitates the maintenance and running operations.

Instead of the calculation being carried out using positions already saved in the electronic memory element, it is possible for the electronic control means to use, for the calculation, instructions supplied directly by the user device 37.

The electronic control means 34 may also manage the electronic memory element 23 in write mode and can write to the electronic memory element 23, if the user device 37 so requests, the previously calculated positions.

Finally, the tuning may be performed, without any calculation, using a set position supplied by the user device 37. Optionally, this position may be saved in the electronic memory element 23 by means of the electronic control means 34.

The electronic control means 34 may carry out a safety check which detects any anomaly in the position sensors 21 and which prevents any movement of the plunger 5 associated with the sensor that has been detected as being defective, these anomalies being, in particular, a sensor failure, a position measurement outside the use limits, a failure in its supply, etc.

Provision may be made for the electronic control means 34 to operate with a password so as to limit access to the commands at risk, such as writing to the electronic memory element and moving the plungers.

The frequency tuning device according to the invention may operate in three different contexts with different user devices.

In the factory, during the phase of setting the tube, the frequency tuning device is connected to a computer which determines, from the tests to which the tube is subjected, set positions corresponding to one or more channels of the tube, these set positions being stored in the electronic memory element.

In use, in the ground transmitting station amplifier application, the frequency tuning device may be connected to the internal management bus of the amplifier and can receive instructions from the amplifier management system or from the transmitting station management system via the amplifier.

In maintenance, the tuning device connected to a suitably programmed computer, for example a portable computer, may be reconfigured depending on the future environment in which it will be used.

What is claimed is:

1. A frequency tuning device for a klystron microwave tube having a tunable resonant cavity with a movable tuning element therein, comprising:

an actuator configured to engage said movable tuning element and change a tuning position of said movable tuning element from a first position to a second position within said tunable resonant cavity;

a sensor configured to directly measure the first position of said movable tuning element; and a microprocessor controller electrically connected to said sensor and electrically connected to said actuator and configured to compare a set value corresponding to said first position of said movable tuning element as measured by said sensor with a second set value corresponding to said second position and deliver a control signal to said actuator to move said movable tuning element to said second position.

2. The device of claim 1, wherein said actuator comprises:

a rotational motor electrically connected to said microprocessor controller; and an auxiliary device mechanically connected to said rotational motor and configured to engage said movable tuning element so as to convert a rotational motion of said rotational motor into a linear motion applied to said movable tuning element to change said tuning position of said movable tuning element.

3. The device of claim 2, wherein said auxiliary device comprises:

a driving shaft mechanically connected to and in-line with said rotational motor; and a driven shaft mechanically connected to said driving shaft, said driven shaft configured to engage said movable tuning element and having an axis being in-line with said movable tuning element, said axis of said driven shaft being offset from said driving shaft and said rotational motor.

4. The device of claim 3, further comprising:

a support arm being integral to said driven shaft and engaged by said driving shaft, said support arm being driven by said driving shaft so as to cause said driven shaft to change said tuning position of said movable tuning element.

5. The device of claim 4, wherein said support arm having a predetermined length that matches an offset dimension of said klystron microwave tube.

6. The device of claim 2, wherein:

said rotational motor, said auxiliary device and said movable tuning element being in-line with respect to each other.

7. The device of claim 2, further comprising:

an electronic memory element electrically coupled to said microprocessor controller and configured to save said set value and said second set value, wherein said sensor, said electronic memory element, and said auxiliary device being within a positioning module that is mechanically connected to said klystron microwave tube.

8. The device of claim 7, wherein said microprocessor controller and said actuator being components of a control module that is mechanically connected to said positioning module.

9. The device of claim 1, wherein said microprocessor controller and said actuator being components of a control module.

10. The device of claim 1, wherein said actuator comprises:

a linear motor electrically connected to said microprocessor controller and configured to engage said movable tuning element so as to change said tuning position of said movable tuning element.

11. The device of claim 1, wherein said microprocessor controller being configured to carry out a safety test to prevent a movement of said movable tuning element when a fault is detected by said microprocessor controller.

12. The device of claim 1, wherein said microprocessor controller being configured to require a password to be operated.

13. The device of claim 1, wherein said microprocessor controller is configured to calculate said second set value.

14. The device of claim 13, further comprising:

a user device electrically connected to said microprocessor controller and configured to deliver a computer-readable instruction to said microprocessor controller so as to calculate said second set value.

15. The device of claim 14, further comprising:

an electronic memory element electrically coupled to said microprocessor controller, wherein said microprocessor controller is configured to save said set value and said second set value in said electronic memory element.

16. The device of claim 13, further comprising:

an electronic memory element electrically coupled to said microprocessor controller, wherein said microprocessor controller is configured to save said set value and said second set value in said electronic memory element.

17. The device of claim 13, wherein said microprocessor controller is configured to calculate said second set value from said set value.

18. The device of claim 17, further comprising:

an electronic memory element electrically coupled to said microprocessor controller, wherein said microprocessor controller is configured to save said set value and said second set value in said electronic memory element.

19. The device of claim 1, further comprising:

a user device electrically connected to said microprocessor controller and configured to deliver said second set value to said microprocessor controller.

20. The device of claim 19, further comprising:

an electronic memory element electrically coupled to said microprocessor controller, wherein said microprocessor controller is configured to save said set value and said second set value in said electronic memory element.

21. The device of claim 1, further comprising:

an electronic memory element electrically coupled to said microprocessor controller and configured to save said set value and said second set value, wherein said sensor and said electronic memory element being within a positioning module that is mechanically connected to said klystron microwave tube.

22. The device of claim 21, wherein said microprocessor controller and said actuator being components of a control module that is mechanically connected to said positioning module.

23. The device of claim 1, further comprising:

an electronic memory element electrically coupled to said microprocessor controller and configured to save said set value and said second set value, wherein, said actuator, said sensor, said microprocessor controller, and said electronic memory element comprise a first mechanism configured to tune said tunable resonant cavity as a first tunable resonant cavity; and said frequency tuning device further comprising, a second mechanism configured to tune a second tunable resonant cavity of said klystron microwave tube.

24. The device of claim 1, wherein:

said klystron microwave tube further comprises, a non-tunable resonant cavity.

25. A tunable klystron microwave tube comprising:

a klystron microwave tube having a tunable resonant cavity with a movable tuning element therein; and a frequency tuning device mechanically connected to said klystron microwave tube including, an actuator configured to engage said movable tuning element and change a tuning position of said movable tuning element from a first position to a second position within said tunable resonant cavity, a sensor configured to directly measure the first position of said movable tuning element, and a microprocessor controller electrically connected to said sensor and electrically connected to said actuator and configured to compare a set value corresponding to said first position of said movable tuning element as measured by said sensor with a second set value corresponding to said second position and deliver a control signal to said actuator to move said movable tuning element to said second position.

26. The tunable klystron microwave tube of claim 25, further comprising:

another frequency tuning device; and another tunable resonant cavity with another movable tuning element therein, wherein, said another frequency tuning device being configured to tune said another tunable resonant cavity.

27. The tunable klystron microwave tube of claim 25, further comprising:

a non-tunable resonant cavity.

* * * * *